US006851642B2

(12) United States Patent
Wilson et al.

(10) Patent No.: US 6,851,642 B2
(45) Date of Patent: Feb. 8, 2005

(54) APPARATUS FOR WEB CUT-OFF IN A REWINDER

(75) Inventors: Matthew R. Wilson, Oshkosh, WI (US); Steven J. Wojcik, Little Chute, WI (US); Christopher L. Satori, Evans, GA (US); Christopher R. Fahrbach, Martinez, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/025,186

(22) Filed: Dec. 19, 2001

(65) Prior Publication Data

US 2003/0111572 A1 Jun. 19, 2003

(51) Int. Cl.[7] ..... B65H 35/04
(52) U.S. Cl. ..... 242/527.1
(58) Field of Search ..... 242/527.1

(56) References Cited

U.S. PATENT DOCUMENTS

| | | | | | |
|---|---|---|---|---|---|
| 2,278,029 | A | | 3/1942 | Walsh et al. | |
| 3,179,348 | A | * | 4/1965 | Nystrand et al. | 242/527.1 |
| 3,505,150 | A | * | 4/1970 | Andersson | 156/446 |
| 3,552,670 | A | * | 1/1971 | Herman | 242/527.1 |
| 3,567,552 | A | | 3/1971 | Heuff et al. | |
| RE28,353 | E | | 3/1975 | Nystrand et al. | |
| 4,243,366 | A | * | 1/1981 | Lefevre et al. | 425/303 |
| 4,280,669 | A | * | 7/1981 | Leanna et al. | 242/527.1 |
| 4,487,377 | A | | 12/1984 | Perini | |
| 4,687,153 | A | | 8/1987 | McNeil | |
| 4,893,534 | A | | 1/1990 | Köbler | |
| 4,919,351 | A | * | 4/1990 | McNeil | 242/521 |
| 5,285,977 | A | | 2/1994 | Biagiotti | |
| 6,056,229 | A | | 5/2000 | Blume et al. | |
| 6,179,241 | B1 | * | 1/2001 | Ba Dour et al. | 242/527.1 |
| 6,513,750 | B2 | * | 2/2003 | Miller | 242/527.1 |

FOREIGN PATENT DOCUMENTS

EP 1072547 A2 1/2001

OTHER PUBLICATIONS

International Preliminary Examiniation Report, Apr. 13, 2004.

* cited by examiner

*Primary Examiner*—Kathy Matecki
*Assistant Examiner*—Sang Kim
(74) *Attorney, Agent, or Firm*—Dority & Manning, P.A.

(57) ABSTRACT

A web cut-off assembly for a rewinder apparatus includes a bedroll having a pair of retractable bedroll blades that move to a protracted position to engage the web material for a web cutting event. A chopper roll is disposed proximate to the bedroll and includes a first blade and a second blade extending from a circumference thereof. The first and second blades rotationally intermeshing with the bedroll blades in the web cutting event. The second blade is configured to effectively stretch and hold the web relative to the bedroll blades as the first blade severs the web in the web cutting process.

23 Claims, 6 Drawing Sheets

APPARATUS FOR WEB CUT-OFF IN A REWINDER

BACKGROUND OF THE INVENTION

The present invention relates generally to rewinders for winding a web material from one or more parent rolls into smaller rolls or logs, and more particularly to an improved apparatus for severing or cutting the web once the desired length of web has been rewound.

High speed rewinder machines are used in the paper industry for producing consumer sized logs or rolls of bathroom tissue, paper towels, and the like, from large parent rolls of the material. The smaller logs are then cut transversely into individual consumer rolls of a desired length. The industry is continuously seeking ways and devices to improve the operating efficiency and reliability of the rewinders.

A critical operation in the timed operating sequence of the rewinders is web cut-off and subsequent transfer of the web leading edge. Once the appropriate measured length of web material has been wound from the parent roll(s) onto the log core, the web must be automatically severed and the leading edge of the web must be transferred to a new core to continue the rewinding process. It is critical that these steps are carried out with relatively great precision and reliability while the web is moving at high speeds.

Various types of cut-off systems have been developed in the art for performing the web cut-off operation. Reference is made to U.S. Pat. Nos. 5,285,977; 6,056,229; 4,919,351; and 4,487,377. One type of conventional rewinder utilizes a cutting blade design with a first retractable blade or blades configured on a main roller ("bedroll") around which the web passes in its running path. A cutting roller ("chopper roll") is disposed adjacent the bedroll and includes a cutting blade configured thereon. For web cut-off, the bedroll blades are driven from their retracted position to a radially extended position wherein they engage and move the web material away from the surface of the bedroll. Rotation of the chopper roll is synchronized with that of the bedroll so that a chopper roll blade intermeshes with the bedroll blades to sever the web. Examples of rewinders using this type of cut-off system include the "Centrum" and "250" rewinders from Paper Converting Machine Co. of Green Bay Wis.

To effectuate a clean cut of the web, it is important that the web is stretched across the bedroll blades and not allowed to slip relative to the bedroll. To aid in this regard, foam or resilient pads are typically mounted on the chopper roll adjacent to the chopper roll blade. These pads serve to press and stretch the web against the tips of the bedroll blades as the chopper roll blades enter between the bedroll blades. Unfortunately, this process subjects the pads to a great deal of stress and wear and the useful life of the pads is relatively short. In high speed operations, it is not uncommon to replace the pads at two hour intervals. Replacement of the pads requires the rewinder to be shut down and results in disruption of the winding operation and significant downtime.

The present invention relates to an improved web cut-off assembly that does not require resilient pads or foam material.

SUMMARY

Objects and advantages of the invention will be set forth in part in the following description, or may be obvious from the description, or may be learned through practice of the invention.

A cut-off assembly according to the invention utilizes an additional blade on the chopper roll that interacts with the bedroll blades to stretch the web and impede slippage or movement of the web as the first chopper roll blade penetrates and sweeps through the web in a cutting sequence.

An embodiment of the invention includes a bedroll disposed such that web material from a parent roll passes around a perforator roll and then around a circumferential portion of the bedroll. A pair of bedroll blades is retractably mounted on the bedroll and move from a recessed position to a protracted position radially beyond the bedroll to engage the web material for a web cutting event. A chopper roll is disposed proximate to the bedroll and includes a first blade and a second blade extending from a circumference thereof. The blades rotationally intermesh with the bedroll blades in the web cutting event. The chopper roll first blade extends at an angle greater than normal with respect to the chopper roll. In other words, the first blade extends at an angle having a tangential and radial component with respect to the chopper roll.

The chopper roll second blade may be a multi-segmented blade wherein the segment defining the blade tip also extends tangentially and radially from the chopper roll but in a non-parallel relationship with the first blade. For example, the blade tip segment may be angled towards the first blade such that a plane of the blade tip segment crosses a plane of the first blade at a desired angle. This angle may be between about 15 degrees to about 30 degrees, more preferably between about 18 degrees to about 28 degrees, and even more preferably at about 23 degrees.

The second chopper roll blade may be resiliently mounted to the chopper roll. For example, the second blade may include a segment that extends generally tangentially and spaced from the chopper roll to render the blade resilient. The blade tip segment may extend at an angle from this resilient segment.

In one embodiment, the tips of the first and second chopper roll blades may be spaced apart a distance greater than a distance between the bedroll blades.

In one particular embodiment, the second chopper roll blade may be a three-segmented blade wherein a first segment defines the blade tip and extends radially and tangentially from the chopper roll. A second segment is angled from the blade tip segment and may be a resilient segment. A third segment is angled from the second segment and is used to attach the blade to the chopper roll. The third segment may extend parallel to the chopper roll first blade and may be mounted against the first blade. In one particular embodiment, the third segment is mounted between the first blade and the chopper roll.

The second chopper roll blade is disposed and angled with respect to the first blade and the chopper roll so as to engage and stretch the web across the bedroll blades as the first chopper roll blade severs the web between the bedroll blades. The chopper roll blade configuration provides an effective holding force against the web during the web cutting event. This holding force may be enhanced by coating or otherwise providing the surface of the second blade that contacts the web material with a friction enhancing substance, such as a high traction tungsten carbide coating.

The invention will be explained in greater detail below with reference to an embodiment shown in the figures.

DETAILED DESCRIPTION

Figure 1:
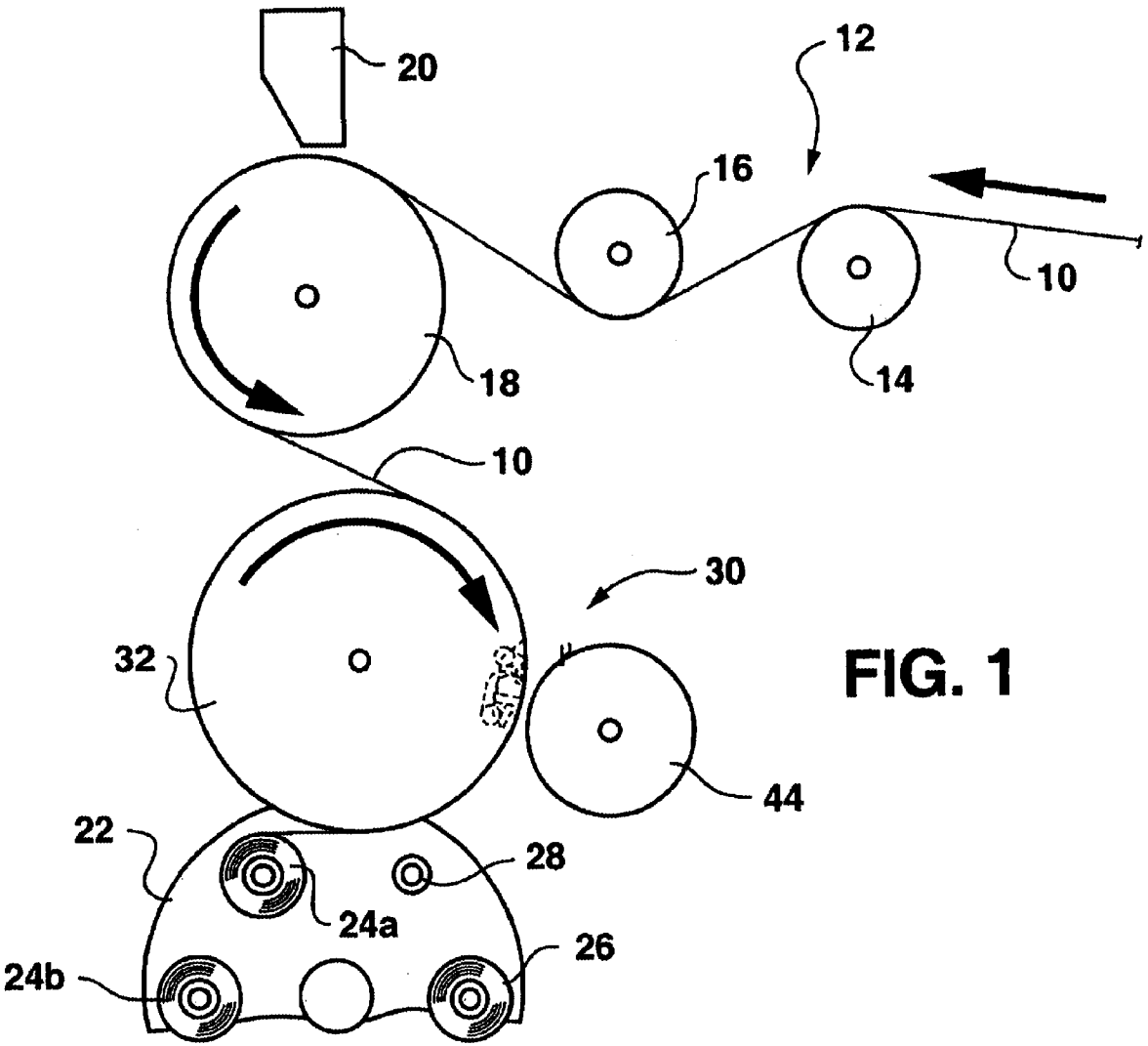
FIG. 1 is a schematic layout view of a rewinder apparatus according to the invention.

Reference will now be made in detail to embodiments of the invention, at least one example of which is illustrated in the drawings. Each embodiment is provided by way of explanation of the invention, and not meant as a limitation of the invention. For example, features illustrated or described as part of one embodiment may be used with another embodiment to yield still a further embodiment. It is intended that the invention includes these and other modifications and variations as come within the scope and spirit of the invention.

As discussed, the present invention relates to an improved web cut-off assembly for a rewinder apparatus. A web cut-off assembly is a section of a rewinder apparatus which is used to convert large parent rolls of paper and other web material to consumer product sized rolls or "logs", for example rolls of toilet tissue, paper towels, etc. A typical layout of a portion of a rewinder apparatus 12 is diagrammatically shown in FIG. 1. The apparatus 12 is operationally disposed downstream of a parent roll (not shown). Web material 10 from the parent roll is conveyed over a pair of guide rolls 14 and 16 and then moves through a perforating section which may include a rotating knife-blade roll 18 and a stationary support 20 for a ledger blade. These components are well understood by those skilled in the art and a detailed explanation thereof is not necessary for purposes of the invention. Briefly, the perforating components provide a line of slits across the entire width of the web 10. The slit lines are spaced at sheet-length intervals in the machine direction. The invention is not limited to any particular type of perforating device.

From the perforating section, the web material passes through the web cut-off assembly 30, as described in greater detail below. Web cut-off assemblies are also known in the art as "chop-off" mechanisms. Such devices 30 are provided to periodically sever or break the web in a web cutting event once the roll or log being wound has reached a desired size. This breaking or severing is induced along a transverse line, which may correspond to one of the perforation lines.

A turret winder 22, or other suitable type of winder, is disposed downstream of the web cut-off assembly 30. The turret winder 22 provides mandrels 26 with cores 28 mounted thereon for producing the logs. FIG. 1 illustrates a log 24*a* being wound onto a core 28, and a previously formed log 24*b*. Although not illustrated in FIG. 1, once a roll 24*b* has been completely wound and severed, the tail end or last sheet of the wound product is sealed down onto the rest of the roll at one turret position, and then the roll product is subsequently removed from the turret winder 22 at the next turret position. After the roll 24*a* has been wound and the web 10 severed by the web cut-off assembly 30, the turret winder 22 is rotated so that an empty core 28 is presented for winding. The empty core was previously placed on a mandrel 26 and an adhesive was applied to the core 28. The mandrel is spun up to winding speed before the web turret 22 is rotated counterclockwise for web transfer and the start of a new roll. This operation is well understood by those skilled in the art, and a further detailed explanation thereof is not necessary for an understanding of the present invention.

Figure 2A:
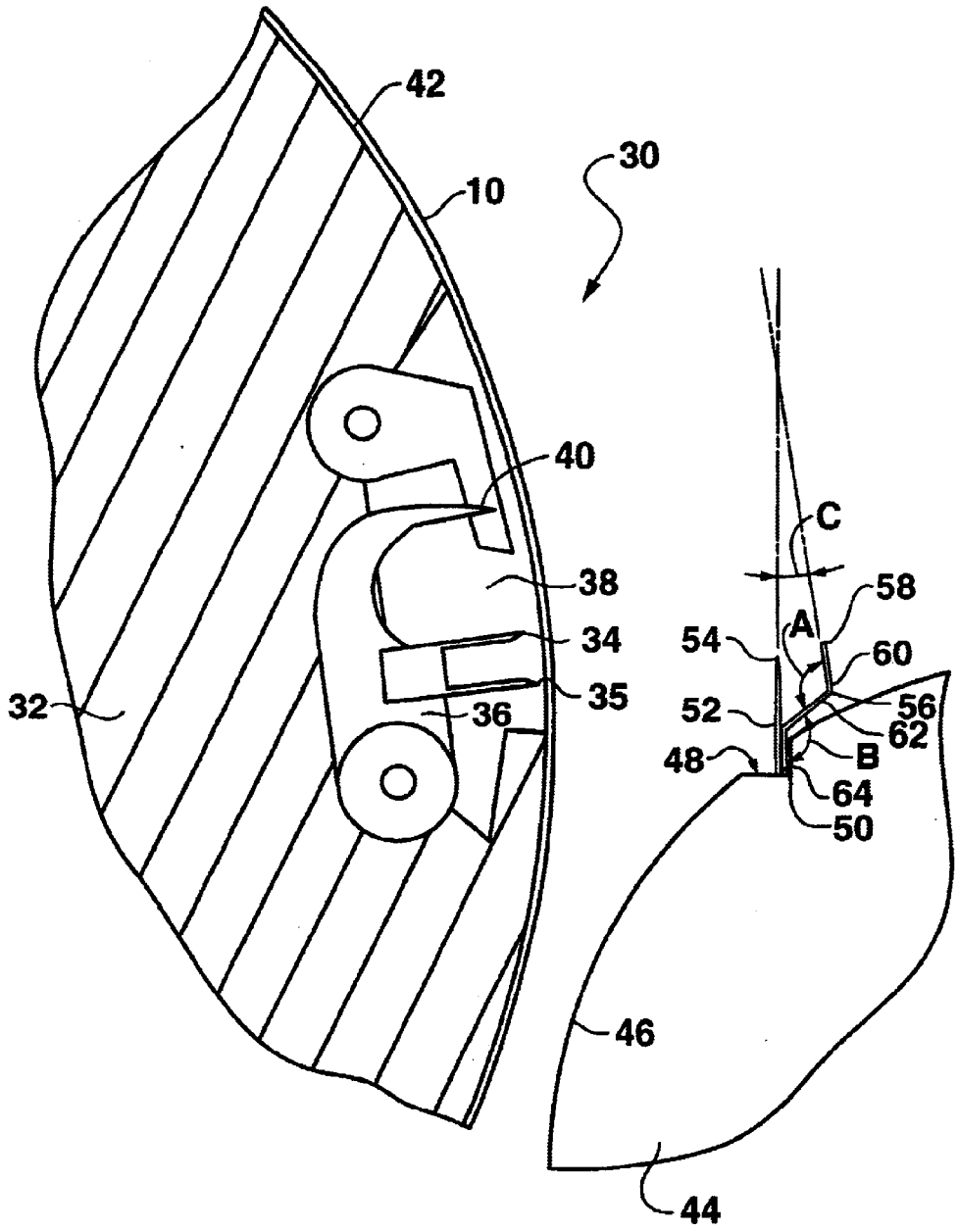
FIGS. 2*a* through 2*e* are schematic sequential operational views of the web cut-off assembly.

Referring to FIG. 1 and FIG. 2*a*, the web cut-off assembly 30 includes a bedroll 32 with circumferential surface 42. The web material 10 passes around a circumferential portion of the bedroll 32, as illustrated in FIG. 1. The bedroll 32 includes a longitudinally extending recess 38. One or more retractable bedroll blades 34, 35 mounted on a suitable carrier 36 are contained within the recess 38. A longitudinally extending row of pins 40 is also contained within the recess 38. Only one pin is illustrated in the Figures. For a web cutting event, the bedroll 32 rotates clockwise and, as it approaches the position illustrated in FIG. 2*b*, the bedroll blades 34, 35 and pins 40 are moved radially out of the recess 38 to the protracted position shown in FIG. 2*b*. This feature of the bedroll 32 and retractable bedroll blades and pins are well known by those skilled in the art. For example, the exemplary bedroll and blade assembly illustrated in the Figures is provided with the commercially available "Centrum" and "250" rewinders from Paper Converting Machine Company of Greenbay, Wis. In this particular arrangement, the blades 34 and 35 and pins 40 are cam driven to the protracted position. The cam mechanism is solenoid activated at the appropriate angular position of the bedroll in the winding sequence.

Figure 2B:
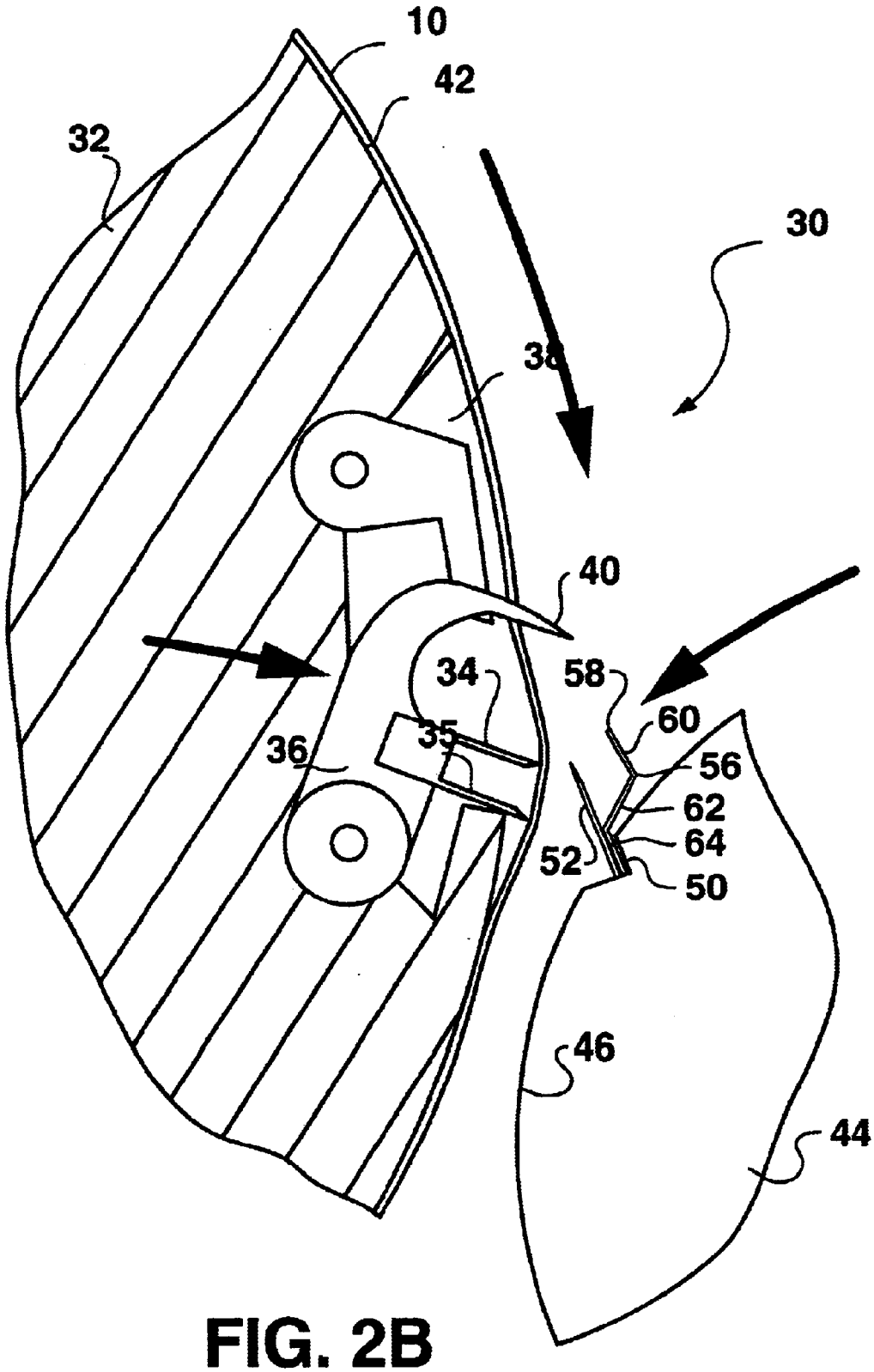

Referring to FIGS. 2*a* and 2*b* in particular, it can be seen that as the bedroll 32 rotates clockwise and the blade carrier 36 moves to its protracted position radially beyond the circumference 42 of the bedroll 32, the web 10 is impaled on the row of pins 40. Also, the web material 10 is lifted from the circumference of the bedroll blade 32 and stretched across the tips of the bedroll blades 34 and 35, as particularly illustrated in FIG. 2*b*.

The web cut-off assembly 30 also includes a chopper roll 44 disposed proximate to the bedroll 32. The chopper roll 44 includes chopper roll blades 52 and 56 stationarily mounted thereto. Rotation of the chopper roll 44 is synchronized with that of the bedroll 32 so that for a web cut-off event, the blades 52 and 56 rotationally intermesh with the bedroll blades 34 and 35 to sever the web material 10 between the bedroll blades, as illustrated in the sequential FIGS. 2*a* through 2*e*.

Referring to FIG. 2*a* in particular, one embodiment of the chopper roll blade configuration according to the invention is illustrated. In this embodiment, the first chopper roll blade 52 is essentially straight and extends tangentially and radially from the circumference 46 of the chopper roll 44. In other words, the blade 52 extends at an angle other than normal to the chopper roll circumference 46. The blade 52 may have a length of about 1.0 inch. The blade 52 may be mounted onto the chopper roll 44 by any convenient mechanism. In the illustrated embodiment, a longitudinal groove 48 is defined along the chopper roll 44 and includes a back wall 50. The wall 50 defines a support surface for mounting the first blade 52. Thus, the wall 50 also defines the angle of the blade 52. It should be appreciated that a similar configuration of a chopper roll 44 and first blade 52 is also used on the "Centrum" and "250" rewinders from Paper Converting Machine Company.

The chopper roll 44 includes a second chopper roll blade 56 defining a blade tip 58. The purpose of the second blade 56 and blade tip 58 is to engage the web material 10 upstream of the first blade 52 and to ensure that the web material 10 is pulled and stretched across the bedroll blades 34, 35 so that the first blade 52 can cleanly sever and separate the web material 10 between the bedroll blades, as particularly illustrated in FIGS. 2*c* and 2*d*. The second blade 56 has various unique characteristics for this purpose. For example, referring to FIG. 2*a*, the second blade 56 may include a blade tip segment 60 that extends in a non-parallel plane with respect to a plane through the first blade 52. Applicants have found that the angle C (FIG. 2*a*) between these planes may desirably be within a range of about 15 to about 30 degrees, and more desirably between about 18 degrees to about 28 degrees. With a particularly desirable embodiment, the angle C between the blades 52 and 56 is about 23 degrees. The segment 60 may have a length, for example, of about 0.375 inches.

It has also been found to be beneficial if the linear distance between the chopper roll blade tips 54 and 58 is greater than the linear distance between the bedroll blades 34 and 35. The angular orientation of the chopper roll blades 52 and 56 and distance between the blade tips 54 and 58 result in a particularly efficient web cutting event with relatively little damage and wear to the chopper roll blades 52 and 56.

It may also be desirable to resiliently mount the second chopper roll blade 56. In the illustrated embodiment, second blade 56 includes a middle or second segment 62 that is angled with respect to the first segment 60. This angle A is preferably greater than about 90 degrees, and may be, for example, about 100 degrees. The angle is such that the second segment 62 is spaced from the chopper roll 44 and extends in a generally tangential direction. The second blade segment 62 thus renders the blade tip segment 60 resilient. This feature may be particularly desirable in that, in the event of a crash and chopper roll wrap-up, the second blade 56 flexes and thus minimizes the potential for damage to both the first blade 52 and second blade 56. The segment may have a length of about 0.575 inches.

It should be appreciated that the second blade 56 can be mounted to the chopper roll 44 by any conventional means. In the illustrated embodiment, the second blade 56 includes a third or base segment 64 that is angled with respect to the resilient middle segment 62. The angle B between the base segment 64 and middle segment 62 may also be greater than 90 degrees, and may be, for example, about 125 degrees. In the illustrated embodiment, the base segment 64 is parallel with the first blade 52 and is mounted between the first blade 52 and wall 50. For example, bolts or the like may be used to mount both blades 52 and 56 directly to the wall 50. The base segment 64 has a length so as to ensure that the middle or resilient segment 62 is spaced radially from the circumference of the chopper roll 44. For example, the base segment 64 may have a length of about 0.445 inches.

It should be appreciated that the present invention encompasses a chopper roll blade assembly incorporating any one of the unique features of the second blade 56 as described herein. For example, an embodiment according to the invention may include a first chopper roll blade 52 and a second chopper roll blade 56 that is spaced from the first blade 52 and is also resiliently mounted to the chopper roll 44. This embodiment may or may not include additional features of the second blade 56 as described herein, such as the angular orientation between the blade tip segment 60 and first blade 52, etc.

Likewise, an embodiment of the invention includes a chopper roll 44 having a first blade 52 extending tangentially and radially from the chopper roll, and a second blade 56 having a blade tip segment 60 also extending tangentially and radially from the chopper roll 44 but in a nonparallel relationship with the first blade 52, as described above. This embodiment may or may not include additional features of the second blade 56 such as, for example, the resilient feature, etc.

Figure 2C:
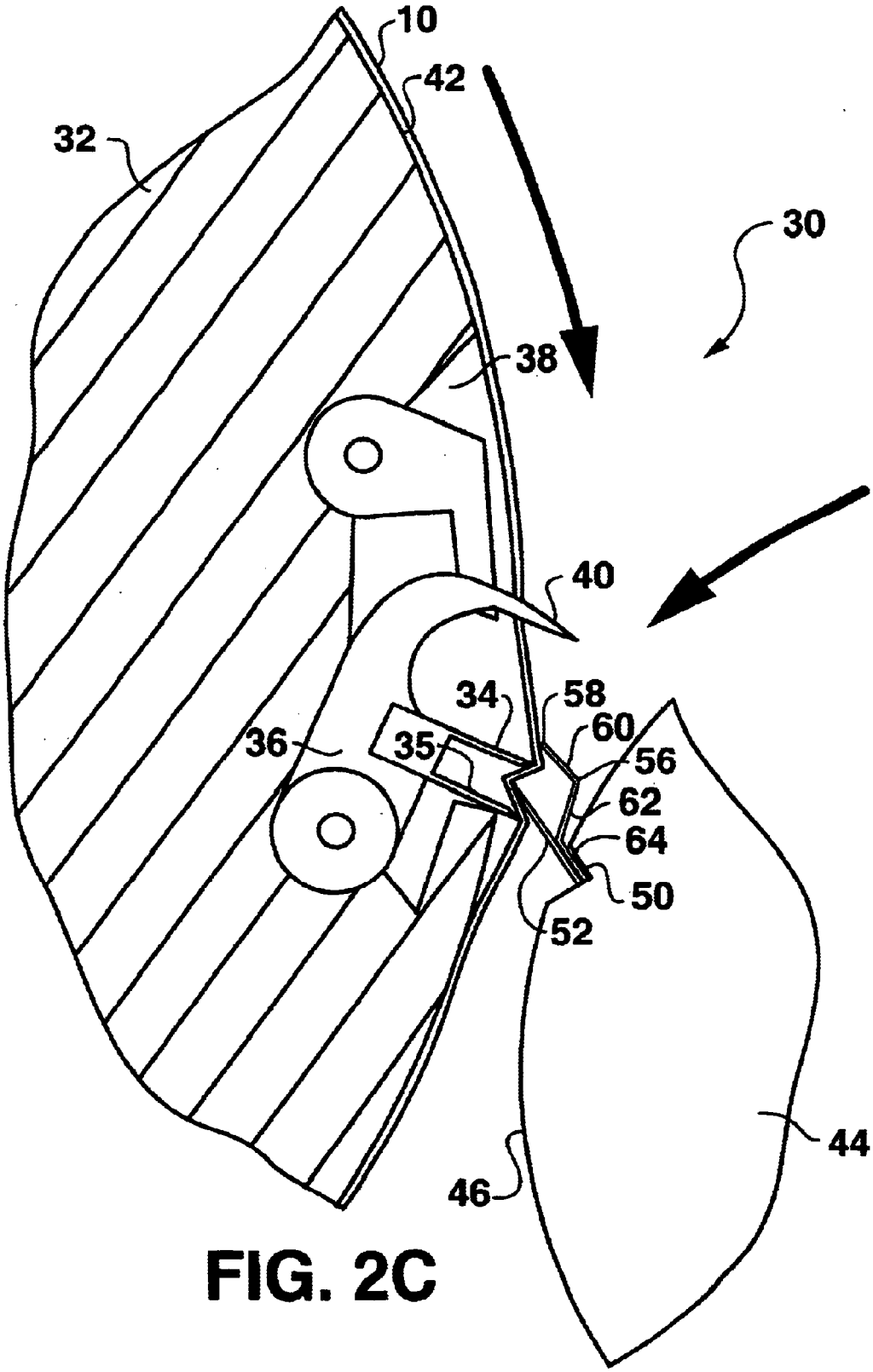
Figure 2D:
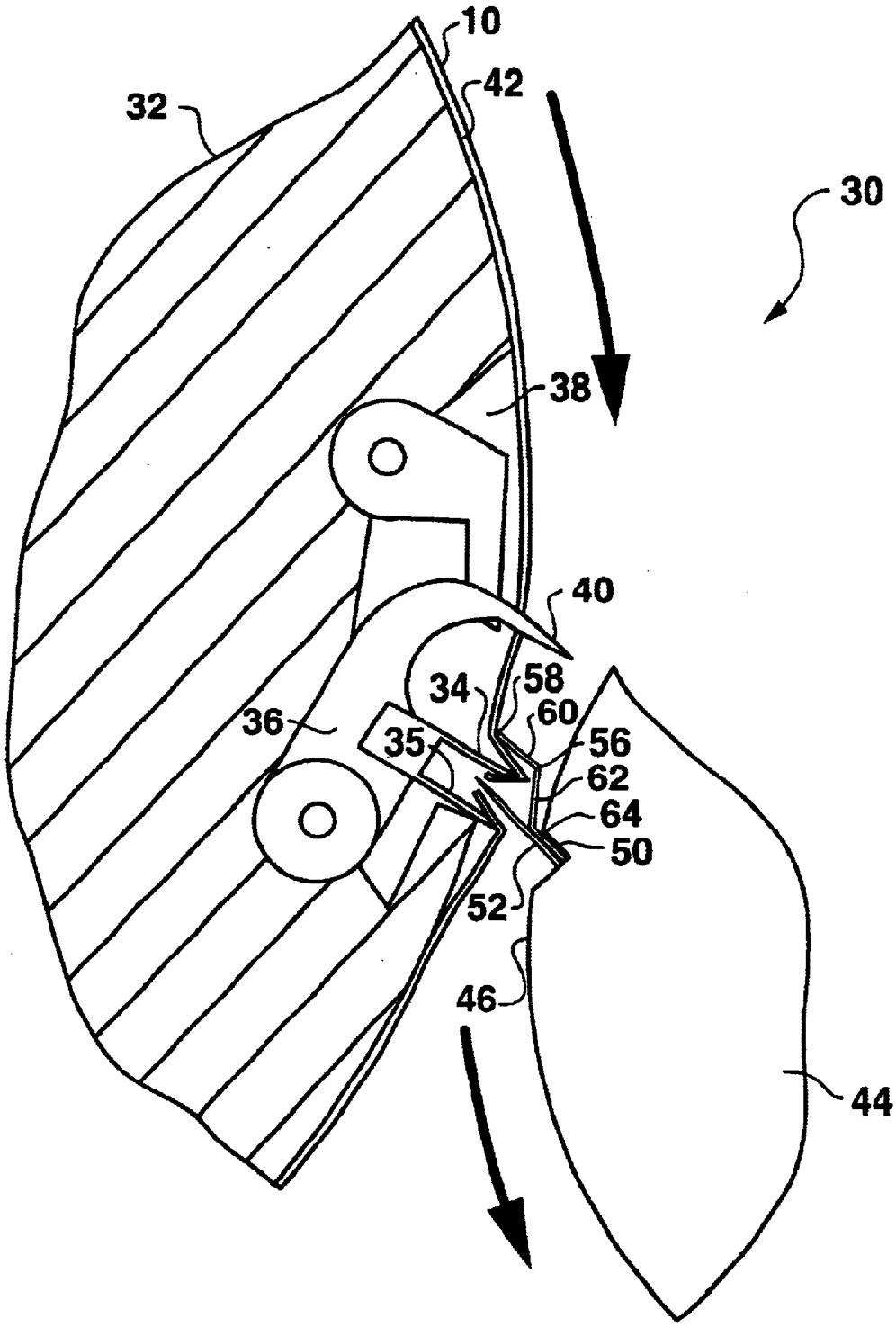
Figure 2E:
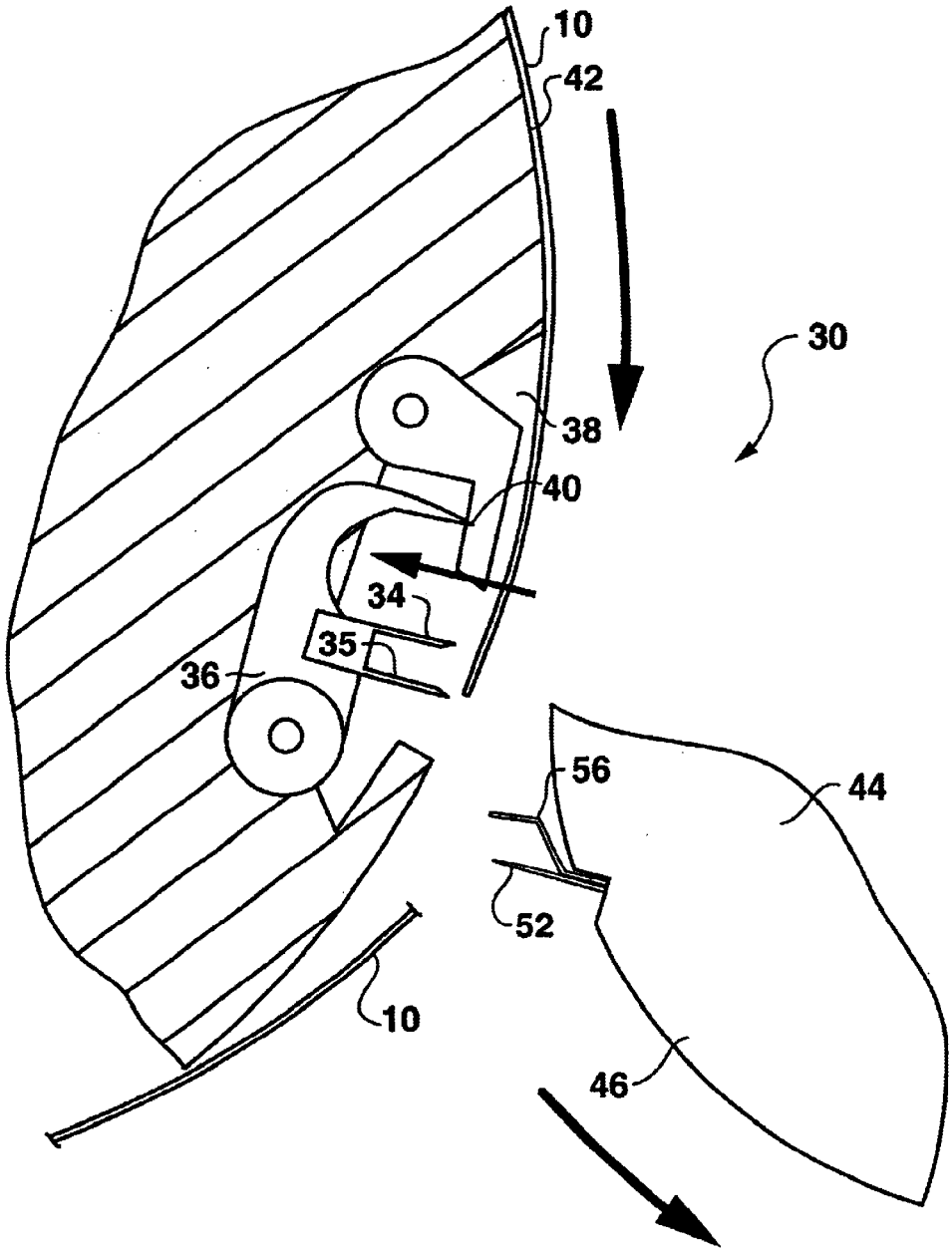

FIGS. 2*b* through 2*e* are sequential operational views of the web cut-off assembly 30. Referring to FIG. 2*b*, the bedroll 32 is approaching the position for a web cutting event. The bedroll blades 34 and 35, as well as the pins 40 are moved out of the recess 38. The pins 40 pierce the web 10, and the blades 34 and 35 engage and stretch the web. Referring to FIG. 2*c*, the chopper roll 44 moves to a rotational position wherein the first blade 52 and second blade 56 engage the web 10. As the first blade 52 engages the web between the bedroll blades 34 and 35, the tip 58 of the second blade 56 engages the web upstream of the first bedroll blade 34 and thus pulls or stretches the web 10 across the tips of the bedroll blades 34 and 35. This action draws the web 10 taunt for a cleaner severing by the first blade 52. As the bedroll 32 and chopper roll 44 continue to rotate, the stretching action of the second blade 56 is increased as the blade tip 58 moves radially closer with respect to the bedroll blades 34 and 35, as particularly illustrated in FIG. 2*d*. Simultaneously, the first blade 52 moves radially between the bedroll blades 34 and 35 and severs the web material 10. FIG. 2*e* shows the position of the various components after the web cutting event. The bedroll blades 34 and 35 and pins 40 are retracted into the recess 38 of the bedroll 32 and the chopper roll 44 continues to rotate and disengages from the web 10.

It should be appreciated by those skilled in the art that various modifications and variations can be made to the chopper roll blade assembly without departing from the scope or spirit of the invention. For example, there are numerous ways to resiliently mount the second blade. Also, there are various angular configurations between the various second blade segments that may be derived to realize the benefits of a two-blade system according to the invention. Any and all such combinations and variations are within the scope and spirit of the invention.

What is claimed is:

1. A web cut-off assembly for a rewinder apparatus, comprising:

a bedroll disposed such that web material from a parent roll passes around a circumferential surface portion of said bedroll;

a pair of bedroll blades retractably mounted on said bedroll, said bedroll blades moveable from a retracted position to a protracted position radially beyond said bedroll to engage the web material for a web cutting event;

a chopper roll disposed proximate to said bedroll, said chopper roll comprising a first blade and a second blade extending from a radius circular circumference surface of said chopper roll, said first and second blades rotationally intermeshing with said bedroll blades in said web cuffing event;

said first blade extending from said chopper roll radius circular circumferential surface at an angle having a tangential and a radial component; and said second blade having a blade tip segment extending from said chopper roll radius circular circumferential surface at an angle having a tangential and a radial component and resiliently mounted to said chopper roll so as to have a resiliency greater than that of said first blade.

2. The web cut-off assembly as in claim 1, wherein said first and second blades comprise blade tips spaced apart a distance greater than a distance between said bedroll blades.

3. The web cut-off assembly as in claim 1, wherein said bedroll blades extend radially from said bedroll.

4. A web cut-off assembly for a rewinder apparatus, comprising:

a bedroll disposed such that web material from a parent roll passes around a circumferential surface portion of said bedroll;

a pair of bedroll blades retractably mounted on said bedroll, said bedroll blades moveable from a retracted position to a protracted position radially beyond said bedroll to engage the web material for a web cutting event;

a chopper roll disposed proximate to said bedroll, said chopper roll comprising a first blade and a second blade extending from a circumference surface of said chopper roll, said first and second blades rotationally intermeshing with said bedroll blades in said web cutting event;

said first blade extending from said chopper roll circumferential surface at an angle having a tangential and a radial component;

said second blade having a blade tip segment extending from said chopper roll circumferential surface at an angle having a tangential and a radial component and resiliently mounted to said chopper roll; and wherein said blade tip segment of said second blade is non-parallel to said first chopper roll blade.

5. The web cut-off assembly as in claim 4, wherein said blade tip segment of said second blade is angled towards said first chopper roll blade.

6. The web cut-off assembly as in claim 5, wherein said blade tip segment of said second blade is disposed in a plane that crosses a plane in which said first chopper roll blade is disposed at an angle of between about 18 degrees to about 28 degrees.

7. A web cut-off assembly for a rewinder apparatus, comprising:

a bedroll disposed such that web material from a parent roll passes around a circumferential surface portion of said bedroll;

a pair of bedroll blades retractably mounted on said bedroll, said bedroll blades moveable from a retracted position to a protracted position radially beyond said bedroll to engage the web material for a web cutting event;

a chopper roll disposed proximate to said bedroll, said chopper roll comprising a first blade and a second blade extending from a circumference surface of said chopper roll, said first and second blades rotationally intermeshing with said bedroll blades in said web cutting event;

said first blade extending from said chopper roll circumferential surface at an angle having a tangential and a radial component; and wherein said second blade comprises a second segment angled with respect to said blade tip segment which is spaced from and generally tangential to said chopper roll.

8. The web cut-off assembly as in claim 7, comprising an angle greater than about 90 degrees between said second segment and said blade tip segment.

9. The web cut-off assembly as in claim 7, wherein said second blade comprises a third segment angled from said second segment in a direction opposite to said blade tip segment.

10. The web cut-off assembly as in claim 9, comprising an angle greater than about 90 degrees between said third segment and said second segment.

11. The web cut-off assembly as in claim 10, wherein said third segment is generally parallel to said chopper roll first blade.

12. The web cut-off assembly as in claim 11, wherein said third segment is mounted against said first blade.

13. The web cut-off assembly as in claim 12, wherein said third segment is mounted between said first blade and said chopper roll.

14. A web cut-off assembly for a rewinder apparatus, comprising:

a bedroll disposed such that web material from a parent roll passes around a circumferential surface portion of said bedroll;

a pair of bedroll blades moveably mounted on said bedroll, said bedroll blades moveable from a recessed position radially within said bedroll to a protracted position radially beyond said bedroll to engage the web material for a web cuffing event;

a chopper roll disposed proximate to said bedroll, said chopper roll comprising a first blade and a second blade extending from a radius circle circumference surface of said chopper roll, said first and second blades spaced so as to rotationally intermesh with said bedroll blades in said web cutting event;

said first blade being a cutting blade and non-movably fixed to said chopper roll; and said second blade resiliently mounted to said chopper roll so as to have a greater degree of resiliency as compared to said first blade.

15. A web cut-off assembly for a rewinder apparatus, comprising:

a bedroll disposed such that web material from a parent roll passes around a circumferential surface portion of said bedroll;

a pair of bedroll blades moveably mounted on said bedroll, said bedroll blades moveable from a recessed position radially within said bedroll to a protracted position radially beyond said bedroll to engage the web material for a web cutting event;

a chopper roll disposed proximate to said bedroll, said chopper roll comprising a first blade and a second blade extending from a circumference surface of said chopper roll, said first and second blades spaced so as to rotationally intermesh with said bedroll blades in said web cutting event;

said first blade being a cutting blade and non-movably fixed to said chopper roll;

said second blade resiliently mounted to said chopper roll; and wherein said first blade of said chopper roll extends from said chopper roll circumferential surface at an angle having a tangential and a radial component, and said second blade extends from said circumferential surface of said chopper roll in a non-parallel relationship to said first blade.

16. The web cut-off assembly as in claim 15, wherein said second blade is angled towards said first blade and has a length so as to engage and stretch the web material across said bedroll blades prior to said first blade entering between said bedroll blades and severing the web material.

17. The web cut-off assembly as in claim 16, wherein a distance between tips of said first blade and said second blade is greater than a distance between said bedroll blades.

18. A web cut-off assembly for a rewinder apparatus, comprising:

a bedroll disposed such that web material from a parent roll passes around a circumferential surface portion of said bedroll;

a pair of bedroll blades moveably mounted on said bedroll, said bedroll blades moveable from a recessed position radially within said bedroll to a protracted position radially beyond said bedroll to engage the web material for a web cutting event;

a chopper roll disposed proximate to said bedroll, said chopper roll comprising a first blade and a second blade extending from a circumference surface of said chopper roll, said first and second blades rotationally intermeshing with said bedroll blades in said web cutting event;

said first blade extending from said chopper roll circumferential surface at an angle having a radial and a tangential component; and said second blade having a blade tip segment extending from said chopper roll circumferential surface in a non-parallel relationship with said first blade and having a length so as to engage and stretch the web material across said bedroll blades prior to said first blade entering between said bedroll blades to sever the web material.

19. The web cut-off assembly as in claim 18, wherein said blade tip segment is angled towards said first blade.

20. The web cut-off assembly as in claim 18, wherein said first blade and said blade tip segment of said second blade comprise tips spaced apart a distance greater than a distance between said bedroll blades.

21. The web cut-off assembly as in claim 18, wherein said second blade further comprises a middle segment angled from said blade tip segment and extending generally transversely to said chopper roll.

22. The web cut-off assembly as in claim 21, wherein said second blade further comprises a base segment mounted to said chopper roll against said first blade.

23. A web cut-off assembly for a rewinder apparatus, comprising:

a bedroll disposed such that web material from a parent roll passes around a circumferential surface portion of said bedroll;

a pair of bedroll blades moveably mounted on said bedroll, said bedroll blades moveable from a recessed position radially within said bedroll to a protracted position radially beyond said bedroll to engage the web material for a web cuffing event;

a chopper roll disposed proximate to said bedroll, said chopper roll comprising a first blade and a second blade extending from a circumference surface of said chopper roll, said first and second blades rotationally intermeshing with said bedroll blades in said web cutting event;

said first blade extending from said chopper roll circumferential surface at an angle having a tangential component with respect to said chopper roll; and said second blade having a blade tip segment extending from said chopper roll circumferential surface at an angle having a tangential component with respect to said chopper roll but not parallel with said first blade, said second blade also having a middle segment angled from said blade tip segment and providing said second blade with a degree of resiliency, and said second blade further comprising a base segment mounted to said chopper roll against said first blade.

* * * * *

UNITED STATES PATENT AND TRADEMARK OFFICE

CERTIFICATE OF CORRECTION

PATENT NO. : 6,851,642 B2
DATED : February 8, 2005
INVENTOR(S) : Matthew R. Wilson et al.

It is certified that error appears in the above-identified patent and that said Letters Patent is hereby corrected as shown below:

Column 8,
Line 10, “cuffing” should be replaced with -- cutting --.

Column 10,
Line 8, “cuffing” should be replaced with -- cutting --.

Signed and Sealed this

Thirteenth Day of September, 2005

JON W. DUDAS
*Director of the United States Patent and Trademark Office*